US005703556A

United States Patent [19]

Kikuta et al.

[11] Patent Number: 5,703,556

[45] Date of Patent: Dec. 30, 1997

[54] IGNITION COIL FOR AN INTERNAL COMBUSTION ENGINE

[75] Inventors: Hikaru Kikuta, Takahama City; Toshiro Suzuki, Nissin City, both of Japan

[73] Assignee: Aisan Kogyo Kabushiki Kaisha, Obu City, Japan

[21] Appl. No.: 769,268

[22] Filed: Dec. 18, 1996

[30] Foreign Application Priority Data

Dec. 27, 1995 [JP] Japan ..... 7-352738

[51] Int. Cl.[6] ..... H01F 15/02; H01F 27/24

[52] U.S. Cl. ..... 336/83; 336/96; 336/110; 336/212; 336/234

[58] Field of Search ..... 336/83, 96, 212, 336/233, 234, 213

[56] References Cited

U.S. PATENT DOCUMENTS

| | | | |
|---|---|---|---|
| 3,497,949 | 3/1970 | Salt | 336/234 |
| 4,848,684 | 7/1989 | Sasaki et al. | 336/212 |
| 5,307,044 | 4/1994 | Watabe | 336/213 |

FOREIGN PATENT DOCUMENTS

A-4-87311 3/1992 Japan .

*Primary Examiner*—Thomas J. Kozma
*Attorney, Agent, or Firm*—Oliff & Berridge

[57] ABSTRACT

The invention is directed to an ignition coil for an internal combustion engine which includes a columnar member having a plurality of magnetic plates, e.g., silicon steel plates stacked one on the other, each of which is a flat plate with its opposite ends having a width greater than that of its middle portion. Each silicon steel plate has a middle portion whose width is gradually increased from the plates placed at the opposite sides of the columnar member to the plate placed in the center of the columnar member, to form a circular cross section. Whereas, the opposite end portions of the columnar member have a rectangular cross section which is greater in area than the circular cross section of the middle portion, respectively. A plurality of recesses are formed on one side of each steel plate, and a plurality of protrusions are formed on the other side of each steel plate. The silicon steel plates stacked one on the other under pressure, so that the recesses and the protrusions are connected to form a plurality of stacked portions on the columnar member. The ignition coil further includes a primary winding and a secondary winding which are wound around the columnar member, a magnetic cylindrical member in which the columnar member is received, and a magnetic cylindrical case in which the cylindrical member and the columnar member are received.

6 Claims, 4 Drawing Sheets

IGNITION COIL FOR AN INTERNAL COMBUSTION ENGINE

BACKGROUND OF THE INVENTION

1. Field of the Invention

The present invention relates to an ignition coil for use in an internal combustion engine, more particularly to an ignition coil having a columnar member with a plurality of magnetic plates stacked one on the other, and a primary winding and a secondary winding wound around the columnar member.

2. Description of the Related Arts

Recently, an ignition coil having a columnar configuration has been proposed so as to place the ignition coil within a cylindrical plug hole formed in an internal combustion engine. In Japanese Patent Laid-open Publication No. 4-87311, for example, there is disclosed an ignition coil having a central core assembled by a plurality of wires made of magnetic material to form a columnar configuration. In that publication disclosed are various methods for producing the central core assembled by the wires, such as a method for drawing the wires through a cylindrical die, a method for placing the wires between an upper die and a lower die, and then pressing them to form the core, a method for aligning the wires and pressing them in dies together with metallic powder, with resin powder adhered thereto, a method for placing the wires within a silicon steel pipe and then drawing the pipe through a die while heating them, and a method for rolling a silicon steel plate double or triple and then drawing it through a die. In that publication, also disclosed is a central core which is assembled by a plurality of wires to form opposite end portions having a rectangular cross section and a middle portion having a circular cross section.

As disclosed in the Publication No. 4-87311, when the ignition coil is to be formed in a cylindrical shape, it is desirable to form the central core or inner core also in the cylindrical shape. However, the methods for assembling a plurality of wires as described above can not be easily made, so that any of the methods will result in increase in cost.

Supposing that a conventional process for stacking a plurality of steel plates is employed to form a columnar core, the core will be formed as shown in FIGS. 8–11. That is, a plurality of silicon steel plates MPx having different width from one another are formed as shown in FIGS. 8–11. A recess is formed on one side of each steel plate MPx, and a protrusion is formed on the other side of each steel plate MPx. The silicon steel plates MPx are stacked one on the other under pressure to form an inner core 10*x* having stacked portions Stb. This "stacking process" is a process for forming a recess on one side, e.g., under side of each of a plurality of flat plates and a protrusion on the other side, e.g., upper side of each of the plates, when the plates are stamped, and then stacking the plates one on the other with each protrusion press-fitted into each recess mating with the protrusion to form a plurality of stacked portions on the plates.

According to the above process, however, if a columnar inner core having a diameter of e.g., 8 mm, is formed by the above process, the width of the outermost plate will be as small as 2 mm, as can be seen in FIG. 8. Therefore, if a plurality of steel plates are connected one another by the stacking process, the diameter of the stacked portion will be small in diameter to have a connecting strength of smaller than 2 kgf, so that the stacked plates will be easily peeled off.

SUMMARY OF THE INVENTION

Accordingly, it is an object of the present invention to provide an ignition coil having a magnetic columnar member and a primary and secondary windings wound on the columnar member for use in an internal combustion engine, wherein the columnar member is formed by stacking a plurality of magnetic plates with a sufficient connecting strength, and provided with a middle portion having a substantially circular cross section.

In accomplishing the above and other objects, an ignition coil for an internal combustion engine includes a magnetic columnar member having a plurality of magnetic plates stacked one on the other with stacked portions formed on at least opposite end portions of the columnar member. Each of the magnetic plates is preferably a flat plate with its opposite ends having a width greater than a middle portion of the flat plate. The width of the middle portion of each of the magnetic plates is gradually increased from the magnetic plates placed at opposite sides of the columnar member to the magnetic plates placed in a center of the columnar member to form the middle portion of the columnar member having a substantially circular cross section. The opposite end portions of the columnar member have a cross section which is greater in area than the cross section of the middle portion of the columnar member. The ignition coil further includes a primary winding and a secondary winding wound around the middle portion of the columnar member, a magnetic cylindrical member for receiving therein the columnar member with the primary winding and secondary winding wound around the columnar member, and a magnetic cylindrical case for receiving therein the cylindrical member and the columnar member.

It is preferable that the opposite end portions of the magnetic plates have a substantially rectangular cross section which is greater in area than the substantially circular cross section of the middle portion of the magnetic plates, respectively. Preferably, the magnetic plates are made of silicon steel plates.

It may be so arranged that a plurality of recesses are formed on one side of each of the magnetic plates, and a plurality of protrusions are formed on the other side of each of the magnetic plates, and that the recesses and the protrusions are connected to form a plurality of stacked portions on the columnar member.

Yet, it may be so arranged that the stacked portions formed on the opposite end portions of the columnar member are greater in area than the stacked portions formed on the middle portions of the columnar member, respectively.

BRIEF DESCRIPTION OF THE DRAWINGS

The above stated objects and following description will become readily apparent with reference to the accompanying drawings, wherein like reference numerals denote like elements, in which.

DESCRIPTION OF THE PREFERRED EMBODIMENT

Figure 1:
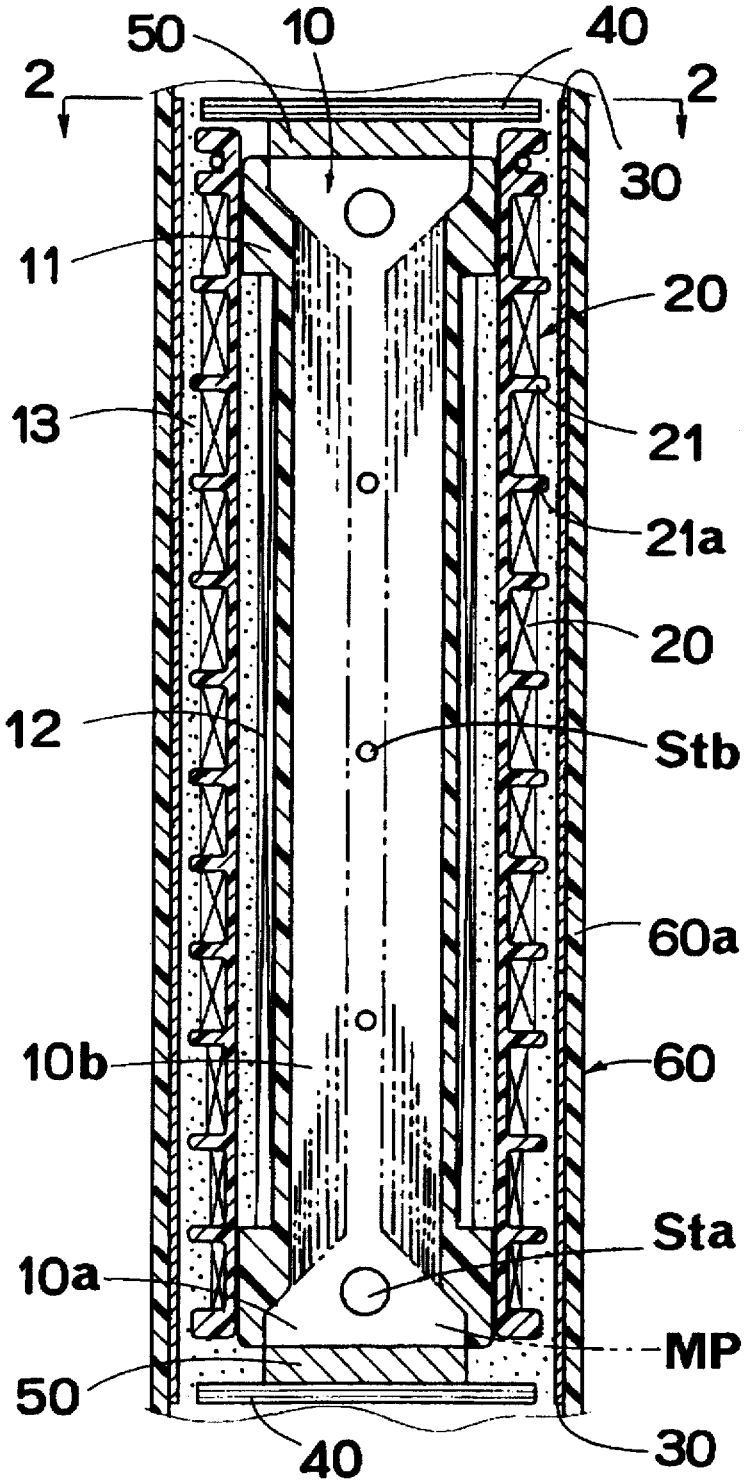
FIG. 1 is a sectional view of an ignition coil for an internal combustion engine according to an embodiment of the present invention.
Figure 2:
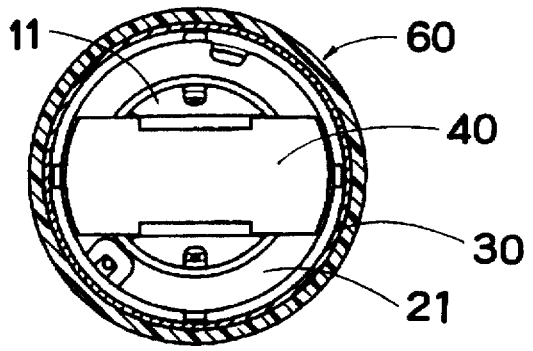
FIG. 2 is a sectional view of the ignition coil sectioned along a line 2—2 of FIG. 1.
Figure 7:
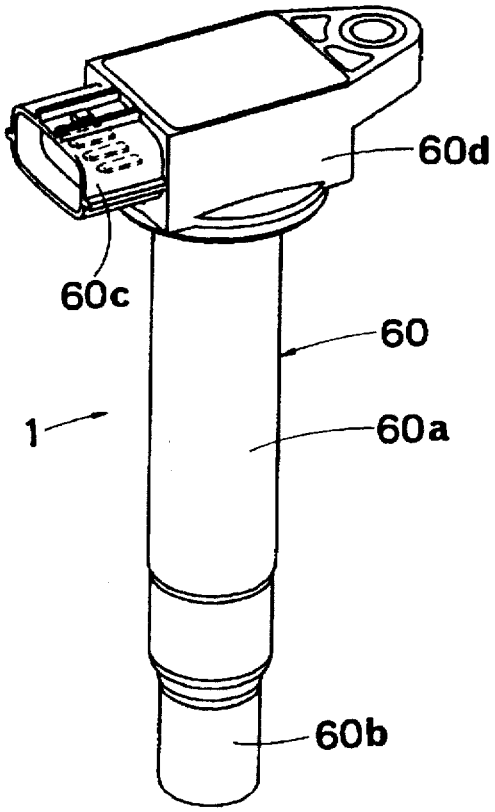
FIG. 7 is a perspective view of the ignition coil according to the embodiment of the present invention.
Figure 8:
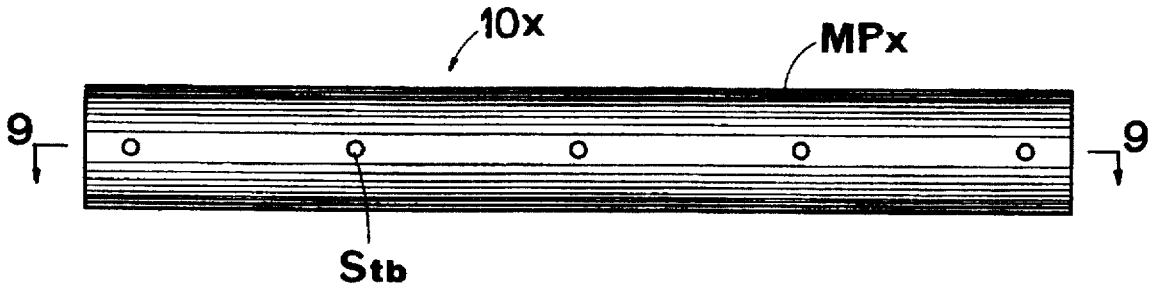
FIG. 8 is a plan view of an inner core having a plurality of silicon steel plates stacked one on the other to form a columnar member having a substantially circular cross section according to a provisional inner core.
Figure 9:
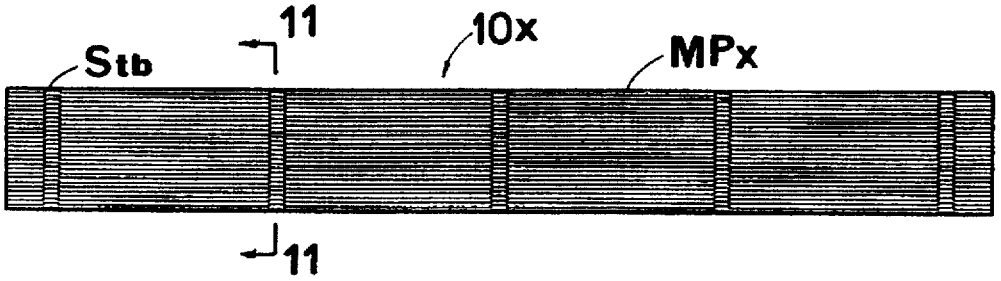
FIG. 9 is a sectional view of the inner core sectioned along a line 9—9 of FIG. 8.
Figure 10:
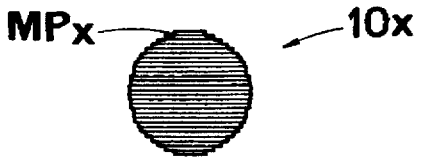
FIG. 10 is a side view of the inner core having the silicon steel plates according to the provisional inner core.
Figure 11:
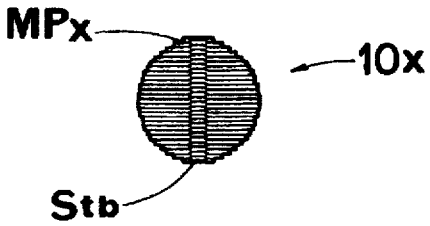
FIG. 11 is a sectional view of the inner core sectioned along a line 11—11 of FIG. 9.

Referring to FIG. 7, there is illustrated an ignition coil for an internal combustion engine according to an embodiment of the present invention. A housing 60 of the present embodiment is a case made of synthetic resin, and includes a box-like igniter portion 60*d* which opens upward, a cylindrical coil portion 60*a* which extends from a bottom of the igniter portion 60*d*, and a plug cap portion 60*b*. The coil portion 60*a* is illustrated in FIGS. 1 and 2, in which the remaining portion of the ignition coil is omitted. FIG. 2 illustrates a sectional view sectioned along a line 2—2 of FIG. 1.

As shown in FIG. 1, the coil portion 60*a* includes therein an inner core 10 which corresponds to a columnar member according to the present invention, a primary bobbin 11 and a primary winding 12 which are formed integrally with the inner core 10, a secondary coil assembly 20, an outer core 30 which corresponds to a cylindrical member according to the present invention, a pair of auxiliary cores 40, 40, and a pair of permanent magnets 50, 50. The igniter portion 60*d* as shown in FIG. 7 includes therein an igniter (not shown) and has a connector portion 60*c* which is formed integrally with the igniter portion 60*d*. The igniter is provided for controlling a primary current of the primary winding 12, and may be called as an ignition module.

Figure 6:
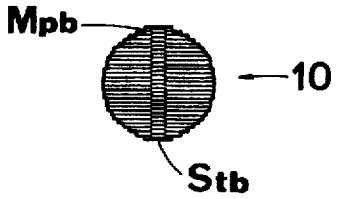
FIG. 6 is a sectional view of the inner core sectioned along line 6—6 of FIG. 4.

FIGS. 3–6 illustrate the inner core 10 which has a plurality of magnetic plates, e.g., silicon steel plates MP which are stacked one on the other as described later, each of which is a flat plate with its opposite end portions MPa having a width greater than that of its middle portion MPb. The silicon steel plates MP are stacked as shown in FIG. 6, i.e., the width of the middle portion Mpb of each plate is gradually increased from the plates which are placed at the opposite sides to the plate which is placed in the center of the stacked steel plates MP. With the steel plates MP stacked, a middle portion 10*b* of the inner core 10 becomes a columnar member having a substantially circular cross section of about 8 mm in diameter. Whereas, the opposite end portions 10*a* have a rectangular cross section which is greater in area than that of the middle portion 10*b*, respectively.

Figure 3:
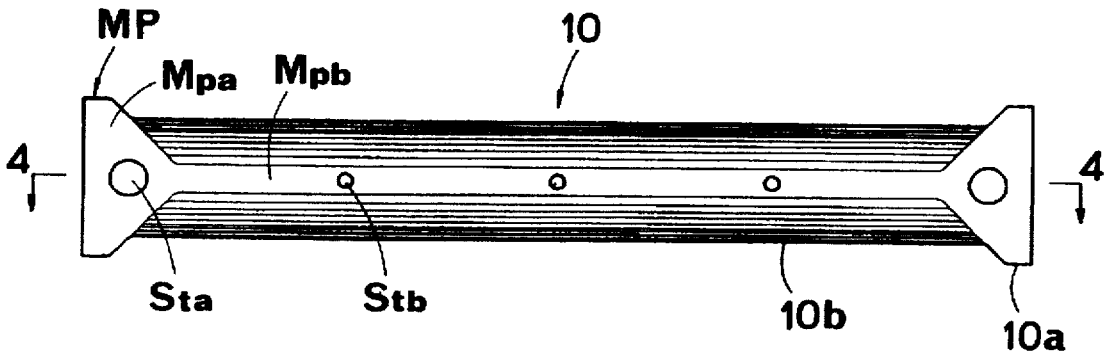
FIG. 3 is a plan view of an inner core according to the embodiment of the present invention.
Figure 4:
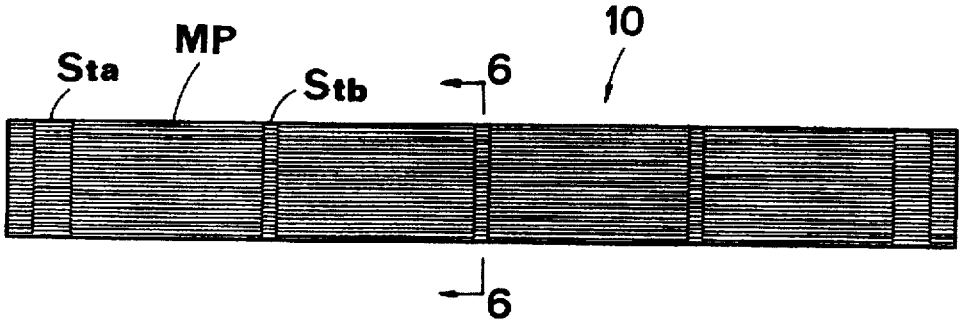
FIG. 4 is a sectional view of the inner core sectioned along line 4—4 of FIG. 3.
Figure 5:
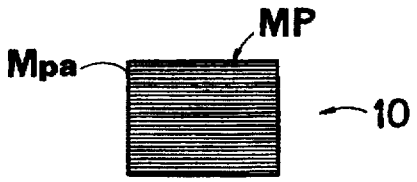
FIG. 5 is a side view of the inner core according to the embodiment of the present invention.

According to the stacking process of the present embodiment, a plurality of recesses are formed on one side of each steel plate MP, and a plurality of protrusions are formed on the other side of each steel plate MP, when the silicon steel plates MP are stamped. Then, the silicon steel plates MP are stacked one on the other with each protrusion press-fitted into each recess mating with the protrusion thereby to form a plurality of stacked portions. In the present embodiment, a pair of large stacked portions Sta are formed on the opposite end portions 10*a* of the inner core 10, and three small stacked portions Stb are formed on the middle portion 10*b* of the inner core 10, so that the silicon steel plates MP are connected one another at five stacked portions Sta, Stb in total. The stacked portions Sta, Stb may be formed to have a cross section of any shapes other than the circular cross section as shown in FIG. 3. According to the present embodiment, since the opposite end portions Mpa of each steel plate MP is formed to be large in width, the stacked portions Sta having a diameter greater than 5 mm can be made to keep a connecting strength greater than 2 kgf. In FIG. 1, the silicon steel plates MP forming the inner core 10 are indicated by two-dot chain lines for better understanding of the structure.

Around the outer side of the inner core 10, molded by synthetic resin is the primary bobbin 11 on which a wire of the primary winding 12 is wound to form two layers or four layers. The secondary coil assembly 20 includes a secondary bobbin 21 and a secondary winding 22 disposed thereon. The secondary bobbin 21 is made of synthetic resin and formed into a cylinder having a circular cross section. A plurality of collars (represented by 21*a*) are formed on the secondary bobbin 21 with a certain space between adjacent two of the collars 21*a* along the axis of the secondary bobbin 21. The wire of the secondary winding 22 is wound in each space between the collars 21*a*.

As shown in FIGS. 1 and 2, the outer core 30 is formed by a silicon steel plate in a cylindrical shape, to provide a magnetic circuit together with the inner core 10. The outer core 30 is fitted into the coil portion 60*a*. The permanent magnets 50, 50 are fixed to the opposite ends of the inner core 10, and further the auxiliary cores 40, 40 are fixed to the permanent magnets 50, 50. Each of the auxiliary cores 40, 40 is formed by stacking a plurality of substantially rectangular silicon steel plates, as shown in FIGS. 1 and 2. The permanent magnets 50, 50 are disposed such that the magnetic flux is generated from each of the permanent magnets 50, 50 normally in the same direction, but in the opposite direction to the magnetic flux which is generated in the inner core 10 when the primary winding 12 is energized. Thus, the magnetic circuit is provided by the inner core 10, permanent magnets 50, 50, auxiliary cores 40, 40, and the outer core 30.

When manufacturing and assembling the above ignition coil, a plurality of, e.g., 27 pieces of silicon steel plates MP (with each thickness of e.g., 0.3 mm) are connected by the stacking process to form the inner core 10 having the end portions 10*a* of a relatively large cross section and the middle portion 10*b* of a relatively small cross section as shown in FIG. 3. The primary bobbin 11 is formed outside of the inner core 10 integrally therewith as shown in FIG. 1, and the primary winding 12 is wound around the primary bobbin 11. The outer core 30 is the cylindrical member formed by the silicon steel plate as described before, and inserted or pressed into the inside of the coil portion 60*a* of the housing 60. The secondary winding 22 is wound around the secondary bobbin 21 to form the secondary coil assembly 20. Then, the primary bobbin 11 having the primary winding 12 wound thereon and the inner core 10 are received in the hollow portion of the secondary bobbin 21, so that the opposite end portions of the primary bobbin 11 are fitted into the hollow portion of the secondary bobbin 21.

The inner core 10, secondary coil assembly 20 and etc. are received into the outer core 30, after the permanent magnets 50, 50 and auxiliary cores 40, 40 are fixed to the opposite ends of the inner core 10. Then, the igniter (not shown) is received into the igniter portion 60*d* of the housing 60, and the opposite ends of the wire of the primary winding 12 is electrically connected to the igniter. One end of the wire of the secondary winding 22 is grounded, and the other end is connected to a high-tension terminal (not shown).

Thereafter, a thermosetting synthetic resin such as epoxy resin is filled into the coil portion 60*a* and igniter portion 60*d*, and set to form a resin portion 13 within the coil portion 60*a* as indicated by dots in FIG. 1 (the resin portion within the igniter portion 60*d* is omitted in FIG. 1). Thus, the primary and secondary windings 12 and 22 are impregnated and made rigid with such resin, and the insulation is ensured to endure the high-tension output from the secondary winding 22. The coil portion 60*a* and plug cap portion 60*b* as shown in FIG. 7 may be formed separate from the igniter portion 60*d* and connector portion 60*c*, and then the coil portion 60*a* may be connected to the igniter portion 60*d*.

The ignition coil 1 is, therefore, formed into the configuration as shown in FIG. 7, and a plug socket (not shown) which is made of insulating material (e.g., rubber) in the form of a cylinder, may be fitted onto the outside of the coil portion 60*a* and plug cap portion 60*b*. Then, the ignition coil 1 is installed in the internal combustion engine (not shown), and connected to an ignition plug (not shown). In operation, when a primary current is fed to the primary winding 12 and cut off, alternately, a counter electromotive force is induced in the secondary winding 22, so that such a high-tension as 30–40 kV is fed to each ignition plug. As a result, a spark discharge is caused at an electrode of the ignition plug to ignite a compressed air-fuel mixture in a combustion chamber (not shown).

As described above, the inner core 10 of the ignition coil 1 includes a plurality of silicon steel plates MP which are stacked one on the other to form its middle portion 10*b* into the columnar member having the substantially circular cross section, and which are connected with sufficient strength at the stacked portions Sta of the end portions 10*a* and the stacked portions Stb of the middle portion lob. As a result, the entire area of the cross section of the middle portion 10*b* can be used for the magnetic circuit, and an effective magnetic flux density can be increased by the end portions 10*a* having the large cross section. Therefore, the area of the cross section of the inner core 10 can be made smaller, maintaining a predetermined ignition property, so that the ignition coil 1 as a whole can be made smaller than the conventional ignition coil.

It should be apparent to one skilled in the art that the above-described embodiment is merely illustrative of but one of the many possible specific embodiments of the present invention. Numerous and various other arrangements can be readily devised by those skilled in the art without departing from the spirit and scope of the invention as defined in the following claims.

What is claimed is:

1. An ignition coil for an internal combustion engine comprising:

a magnetic columnar member having a plurality of magnetic plates stacked one on the other with stacked portions formed on at least opposite end portions of said columnar member, each of said magnetic plates being a flat plate with opposite ends thereof having a width greater than a middle portion of said flat plate, the width of the middle portion of each of said magnetic plates being gradually increased from said magnetic plates placed at opposite sides of said columnar member to said magnetic plates placed in a center of said columnar member to form the middle portion of said columnar member having a substantially circular cross section, the opposite end portions of said columnar member having a cross section greater in area than the cross section of the middle portion of said columnar member, respectively;

a primary winding and a secondary winding wound around the middle portion of said columnar member;

a magnetic cylindrical member for receiving therein said columnar member with said primary winding and said secondary winding wound around said columnar member; and a magnetic cylindrical case for receiving therein said cylindrical member and said columnar member.

2. An ignition coil for an internal combustion engine as set forth in claim 1, wherein the opposite end portions of said magnetic plates have a substantially rectangular cross section which is greater in area than the substantially circular cross section of the middle portion of said magnetic plates, respectively.

3. An ignition coil for an internal combustion engine as set forth in claim 1, wherein a plurality of recesses are formed on one side of each of said magnetic plates, and a plurality of protrusions are formed on the other side of each of said magnetic plates, and wherein said recesses and said protrusions are connected to form a plurality of stacked portions on said columnar member.

4. An ignition coil for an internal combustion engine as set forth in claim 3, wherein said stacked portions formed on the opposite end portions of said columnar member are greater in area than said stacked portions formed on the middle portions of said columnar member, respectively.

5. An ignition coil for an internal combustion engine as set forth in claim 1, wherein said magnetic plates are made of silicon steel plates.

6. An ignition coil for an internal combustion engine as set forth in claim 1, further comprising a synthetic resin filled in said cylindrical member for fixing and insulating said primary winding and said secondary winding.

* * * * *